US007159524B2

(12) United States Patent
Lothe

(10) Patent No.: US 7,159,524 B2
(45) Date of Patent: Jan. 9, 2007

(54) LOADING PIPE IN A CARGO PRESSURE TANK OF A SHIP

(75) Inventor: Per Lothe, Førresflorden (NO)

(73) Assignee: Knutsen OAS Shipping AS (NO)

( * ) Notice: Subject to any disclaimer, the term of this patent is extended or adjusted under 35 U.S.C. 154(b) by 0 days.

(21) Appl. No.: 10/519,506

(22) PCT Filed: Jun. 26, 2003

(86) PCT No.: PCT/NO03/00215

§ 371 (c)(1),
(2), (4) Date: Dec. 22, 2004

(87) PCT Pub. No.: WO2004/005790

PCT Pub. Date: Jan. 15, 2004

(65) Prior Publication Data

US 2006/0005757 A1 Jan. 12, 2006

(30) Foreign Application Priority Data

Jul. 4, 2002 (NO) ..... 20023256

(51) Int. Cl.
*B63B 25/08* (2006.01)

(52) U.S. Cl. ..... 114/74 R

(58) Field of Classification Search ..... 114/74 R; 220/581

See application file for complete search history.

(56) References Cited

U.S. PATENT DOCUMENTS

| | | | | |
|---|---|---|---|---|
| 1,938,036 | A * | 12/1933 | Martin et al. | 222/4 |
| 2,537,085 | A | 1/1951 | Phelps | |
| 3,537,416 | A | 11/1970 | Cowles | |
| 3,830,180 | A | 8/1974 | Bolton | |
| 3,886,885 | A | 6/1975 | Becker et al. | |
| 5,213,054 | A * | 5/1993 | Gallagher et al. | 114/74 R |
| 5,294,917 | A * | 3/1994 | Wilkins | 340/625 |

FOREIGN PATENT DOCUMENTS

| | | |
|---|---|---|
| FR | 1452058 | 9/1966 |
| GB | 818073 | 8/1959 |
| NO | 133461 | 1/1976 |

* cited by examiner

*Primary Examiner*—Stephen Avila
(74) *Attorney, Agent, or Firm*—Andrus, Sceales, Starke & Sawall, LLP

(57) ABSTRACT

A device for a pipe (10) in a cargo pressure tank of a ship (2), the pipe (10) mainly being used for loading and unloading of fluids, and the open end portion (13) of the pipe (10) being placed immediately above the lower bottom section (14) of the cargo pressure tank (1).

8 Claims, 2 Drawing Sheets

II–II

LOADING PIPE IN A CARGO PRESSURE TANK OF A SHIP

CROSS REFERENCE TO RELATED APPLICATION

The present application is the U.S. national stage application of International Application PCT/NO03/00215, filed Jun. 26, 2003, which international application was published on Jan. 14, 2004 as International Publication WO 2004/005790. The International Application claims priority of Norwegian Patent Application 20023256, filed Jul. 4, 2002.

BACKGROUND OF THE INVENTION

This invention regards a loading pipe in the cargo pressure tank of a ship. In particular, it concerns a pipe placed inside a cargo pressure tank, wherein the pipe is arranged especially for use during loading and unloading of the ship.

Sea transport of gaseous petroleum products has taken place mainly by means of the so-called Liquefied Natural Gas (LNG) method. The method includes cooling of gas to a liquid state, whereupon the gas may be transported in ship tanks at atmospheric pressure. Costly equipment is required both at the location of shipment and at the receiving end. As the gas must be cooled to a relatively low temperature, up to a fifth of the gas is used for operation of the cooling and heating processes. Consuming this amount of energy solely for transport-related processes is expensive and also environmentally questionable.

Several other ship-based solutions have been proposed, in which the gas is pressurised and/or cooled in order to attain a gas density that is practical for the purpose. Such solutions have gained little practical use, but a solution in which a large number of vertical tubular pressure tanks are placed in the cargo hold of a ship, has attracted considerable attention. The method is termed Pressurised Natural Gas—PNG. According to such a method, the gas is compressed at the shipment site to an overpressure of a couple of hundred bars, and then is filled onto the cargo pressure tanks located on the ship. The cooling is limited to a simple and inexpensive removal of the compression heat from the gas, the transport temperature thus becoming close to the ambient temperature.

When using a relatively large number of preferably vertically mounted cargo pressure tanks in the hold of the ship, it is desirable for each cargo pressure tank to have as few pipe connections as possible. Pipe connections subjected to high pressure during loading, transport and unloading should be monitored continuously.

Essentially, the pipework of the ship must allow complete emptying of the cargo pressure tank. Moreover, it must be designed so as to allow easy inspection of the external pipe connections on the cargo pressure tank.

SUMMARY OF THE INVENTION

The object of the invention is to describe a device in which it is possible, by means of a singular pipe connection, to meet the above-mentioned characteristics.

The object is achieved in accordance with the invention by means of features disclosed in the description below and in the subsequent patent claims.

Prior to finishing the top section of the cargo pressure tank and inseparably connecting it to the cylindrical mid-section of the cargo pressure tank, a pipe is placed inside the cargo pressure tank. The pipe projects from just above the inner bottom section of the cargo pressure tank and preferably up to the upper section of the cargo pressure tank wherein the pipe, via a bushing through the wall of the cargo pressure tank, is connected to the external pipe connection of the cargo pressure tank.

In at least one position along its longitudinal extent, the pipe is connected to a guide displaceable against the internal wall of the cargo pressure tank.

Preferably suspended from the upper section of the cargo pressure tank, the pipe thus may expand freely in its longitudinal direction through displacement in the longitudinal direction of the pipe. In order to prevent mutual, relative movement between the cargo pressure tank and the pipe in the radial direction of the pipe, and to dampen any vibrations that might occur in the pipe, the guides preferably are lightly pretensioned against the internal wall of the cargo pressure tank.

During loading, fluid flows down through the pipe to the bottom section of the cargo pressure tank, whereby the pressure in the cargo pressure tank increases. When the cargo pressure tank is filled with petroleum gases, for example, only a negligible part of the cargo volume in the cargo pressure tank will be in gas phase due to the relatively high pressure.

During unloading from the ship, if a portion of the gases condensed in the cargo pressure tanks during loading does not boil off again, thereby following the liquid phase out of the cargo pressure tank, insufficient pressure remains in the cargo pressure tank to drive all of the cargo liquid phase up through the pipe. This may be remedied by pumping pressurised gas down through the pipe. The pressure in the cargo pressure tank thereby is sufficiently increased to drive the remaining liquid phase out before the remaining gas then flows out until the pressure in the cargo pressure tank is approximately equal to the desired pressure.

If desired, the pipe guide(s) may be fixedly attached to the cargo pressure tank, while the pipe may be moved in the guide.

Essentially, the pipe suspended in the cargo pressure tank is subjected to the load of its own weight only. Moreover, a relatively moderate pressure difference will exist between the inside and the outside of the pipe. The cargo density and the height of the cargo pressure vessel determine the pressure difference. Thus, the pipe may be provided with relatively small material thickness, as the pipe is braced by at least one guide.

BRIEF DESCRIPTION OF THE DRAWINGS

The following describes a non-limiting example of a preferred embodiment illustrated in the accompanying drawings, in which.

DETAILED DESCRIPTION OF THE INVENTION

Figure 1:
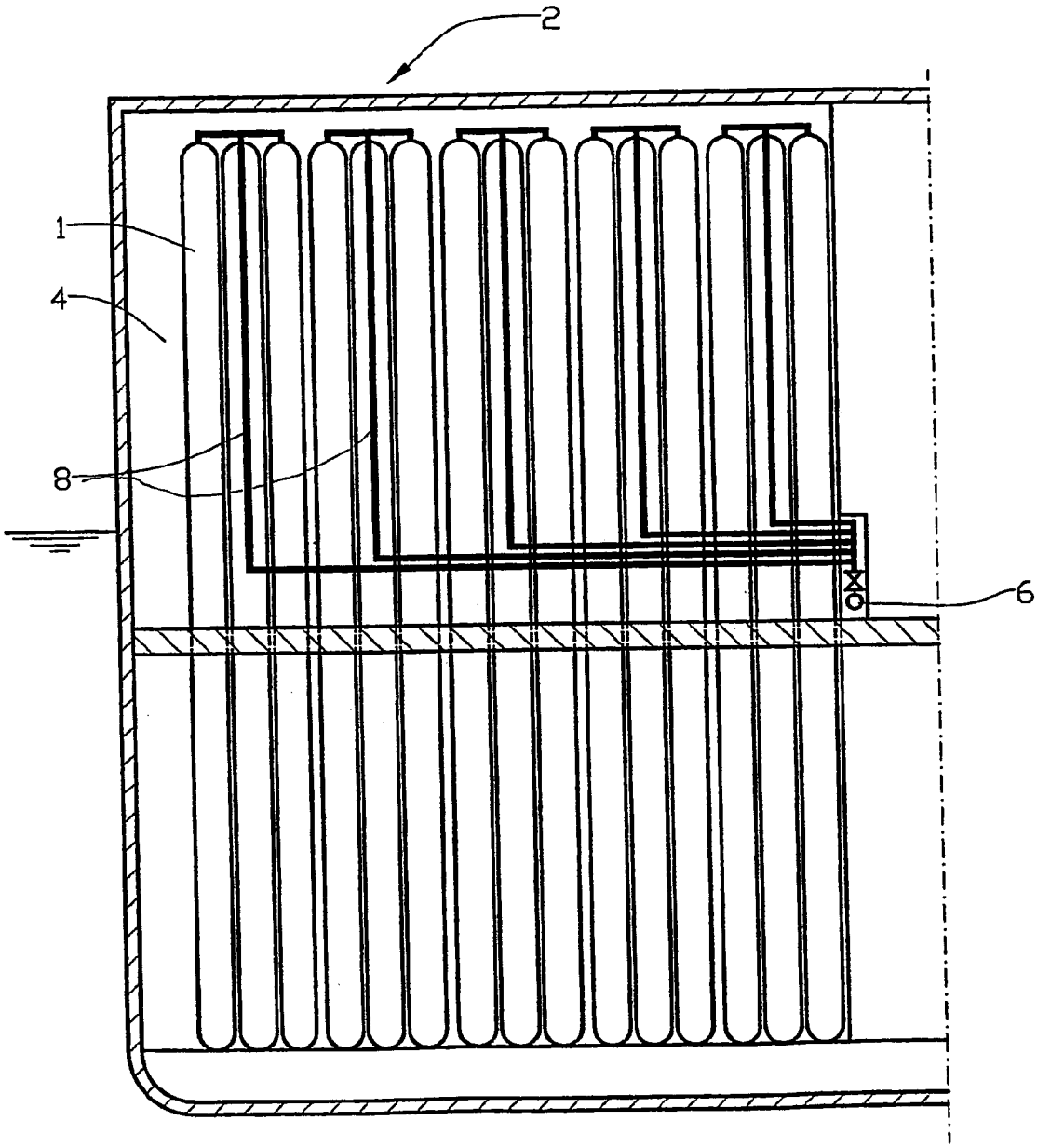
FIG. 1 schematically shows a section through a larger number of cargo pressure tanks installed in a hold of a ship.
Figure 3:
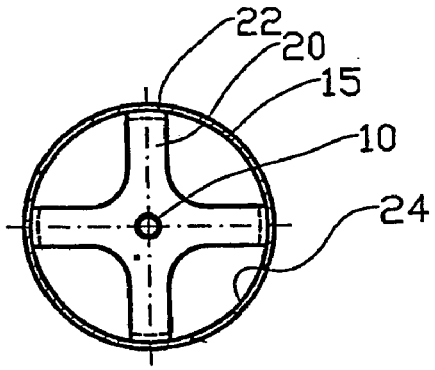
FIG. 3 shows a section II—II in FIG. 2.
Figure 2:
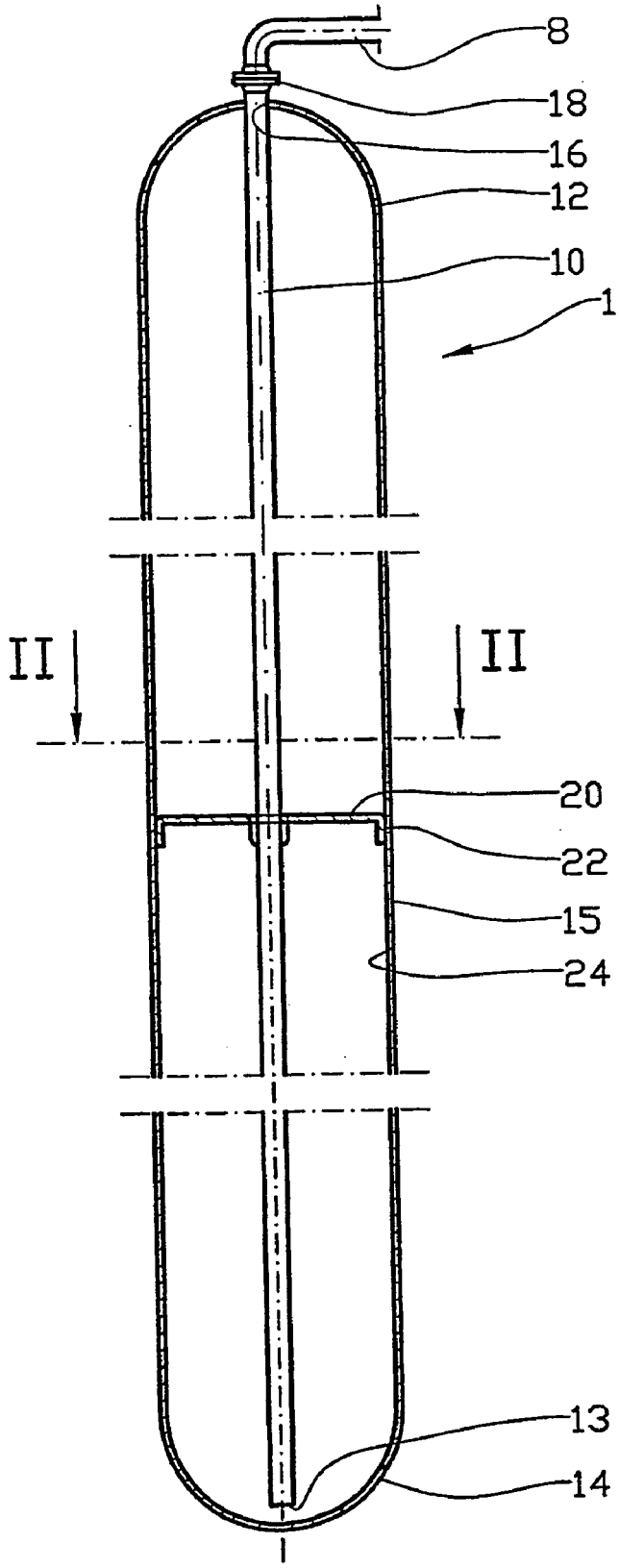
FIG. 2 shows a longitudinal section through a cargo pressure tank.

In the drawings, reference number 1 denotes a cargo pressure tank that together with other cargo pressure tanks 1, is arranged upright in a hold 4 of a ship 2. The cargo pressure tanks 1 are connected individually or in groups to the main loading and unloading pipe 6 of the ship via connecting pipes 8.

A pipe 10 projects downward from the upper section 12 of the cargo pressure tank 1, and its opening 13 is placed immediately above the lower section 14 of the cargo pressure tank 1. The pipe is sealingly conducted through an opening 16 in the upper section 12 of the cargo pressure tank 1 and is connected to a pipe coupling 18, shown in the form of a pipe flange herein.

The upper and the lower sections 12, 14 of the cargo pressure tank 1 are inseparably connected to the cylinder body 15 of the cargo pressure tank 1.

The pipe coupling 18 is sealingly connected to one of the connecting pipes 8.

In at least one position along its longitudinal extent, the pipe 10 is provided with a substantially radially projecting guide 20. The sliding surfaces 22 of the guide 20 bear displaceably against the internal wall 24 of the cargo pressure tank 1.

The pipe 10, which is thus suspended from and connected to the cargo pressure tank 1, is arranged to allow it to essentially expand freely in its longitudinal direction, simultaneously being prevented from moving in the radial direction by the guide 20.

Thus the pipe 10 is subjected to relatively small mechanical loads and may be of a slender construction.

Loading and unloading of the cargo pressure tank 1 by means of the pipe 10 is carried out in a manner described in the general part of the description.

The guide 10 may have alternative geometric designs, for example a spherical shape, and being provided with, for example, a damper material on the sliding surfaces 22.

The invention claimed is:

1. A cargo pressure tank for the transport of petroleum products, the cargo pressure tank comprising:

a tank body having an upper end and a lower end;

an elongated pipe disposed in the tank body, the pipe having its first open end positioned adjacent the lower end of the tank body and its second open end sealingly engaged with the upper end of the tank body;

wherein the pipe is arranged to facilitate loading and unloading of pressurized natural gas in either a liquid or nearly liquid state into and out of the cargo pressure tank;

wherein the pipe is provided with at least one guide, the guide being arranged to reduce displacement of the pipe in the radial direction, and wherein the guide is located between the upper and lower ends of the tank body and is displaceable in the longitudinal direction of the cargo pressure tank.

2. The cargo pressure tank according to claim 1, wherein the pipe extends from and is suspended from the top section of the cargo pressure tank.

3. The cargo pressure tank according to claim 1, wherein the second open end of the pipe is attached to the uppermost part of the tank body.

4. The cargo pressure tank of claim 1, wherein the guide is pretensioned against an internal wall of the cargo pressure tank.

5. The cargo pressure tank of claim 1, wherein the guide comprises sliding surfaces for contacting an internal wall of the cargo pressure tank.

6. The cargo pressure tank of claim 5, wherein the sliding surfaces comprise a damper material.

7. A cargo pressure tank for the transport of petroleum products, the cargo pressure tank comprising:

a tank body having an upper end and a lower end;

an elongated pipe disposed in the tank body, the pipe having its first open end position adjacent the lower end of the tank body and its second open end sealingly engaged with the upper end of the tank body;

wherein the pipe comprises the only connection between the outside and inside of the cargo pressure tank, and is arranged to load and unload pressurized natural gas in either a liquid or nearly liquid state into and out of the cargo pressure tank;

at least one guide disposed in the tank body and arranged to reduce displacement of the pipe in the radial direction;

wherein the guide comprises sliding surfaces for contacting an internal wall of the cargo pressure tank.

8. The cargo pressure tank of claim 7, wherein the sliding surfaces comprise a damper material.

* * * * *